US008478172B2

(12) United States Patent
Ichikawa

(10) Patent No.: US 8,478,172 B2
(45) Date of Patent: Jul. 2, 2013

(54) TRANSPORT MEMBER FOR POWDER TRANSPORT, DEVELOPING POWDER ACCOMMODATION CONTAINER, AND IMAGE FORMING APPARATUS

(75) Inventor: Hideo Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 512 days.

(21) Appl. No.: 12/466,824

(22) Filed: May 15, 2009

(65) Prior Publication Data

US 2010/0111574 A1 May 6, 2010

(30) Foreign Application Priority Data

Nov. 5, 2008 (JP) ..... P2008-284697

(51) Int. Cl.
*G03G 15/08* (2006.01)

(52) U.S. Cl.
USPC ..... 399/263; 399/256

(58) Field of Classification Search
USPC ..... 399/119, 120, 222, 252, 254–256, 399/258, 259, 262, 263
See application file for complete search history.

(56) References Cited

U.S. PATENT DOCUMENTS

| | | | | |
|---|---|---|---|---|
| 4,610,068 A | | 9/1986 | Schultz | 29/418 |
| 4,887,132 A | | 12/1989 | Joseph et al. | 355/253 |
| 4,956,675 A | | 9/1990 | Joseph | 355/251 |
| 5,228,775 A | | 7/1993 | Horn et al. | 366/278 |
| 5,572,297 A | * | 11/1996 | Kawashima | 399/257 |
| 5,655,195 A | * | 8/1997 | Ichikawa et al. | 399/263 |
| 5,835,828 A | * | 11/1998 | Jyoroku | 399/256 |
| 2001/0014230 A1 | | 8/2001 | Kusayanagi | 399/101 |
| 2002/0150410 A1 | | 10/2002 | Matsuda et al. | 399/263 |
| 2008/0240789 A1 | | 10/2008 | Norigoe | 399/254 |

FOREIGN PATENT DOCUMENTS

| | | |
|---|---|---|
| JP | 10-247009 | 9/1998 |
| JP | 2000-305344 | 11/2000 |
| JP | 2004-307139 A | 11/2001 |
| JP | 2002-268344 | 9/2002 |
| JP | 2004-252184 | 9/2004 |
| JP | 2005-134452 | 5/2005 |
| JP | 2005-181515 | 7/2005 |
| JP | 2006-053446 | 2/2006 |
| JP | 2006-267680 A | 10/2006 |
| JP | 2008-241880 A | 10/2008 |
| JP | 2008-242189 A | 10/2008 |
| KR | 2001-100787 | 11/2001 |

* cited by examiner

*Primary Examiner* — Walter L Lindsay, Jr.
*Assistant Examiner* — Benjamin Schmitt
(74) *Attorney, Agent, or Firm* — Sughrue Mion, PLLC

(57) ABSTRACT

A transport member for a powder transport includes a revolving shaft, a transport part that extends in a helical shape relative to an axial direction of the revolving shaft, includes one end part with a free end and the other end part at an opposite side of the one end part, and transports a powder at the time of revolution of the revolving shaft, and one support part that supports the other end part of the transport part by being arranged with the revolving shaft, wherein the transport part is not supported by another support part that is arranged at an phase angle between the one support part and the another support part of 90 degrees or more, in a direction of the revolving shaft.

7 Claims, 13 Drawing Sheets

VIIB
VIIC
VIID
VIIE
Yb
Ya
16
21
21a
22
22a
22b
22c
23
24
26
26a
26b
31
32
33
33a
34
36
X
Y
Z
(−X)
(−Y)
(−Z)

XIIIB
XIIIC
Z
X
(-Y)
Y
(-X)
(-Z)
21
21a
22
22a
22b
22c
23
31
32
33
33a
34
36
216
223
224
226
226a
226b

TRANSPORT MEMBER FOR POWDER TRANSPORT, DEVELOPING POWDER ACCOMMODATION CONTAINER, AND IMAGE FORMING APPARATUS

CROSS-REFERENCE TO RELATED APPLICATION

This application is based on and claims priority under 35 USC 119 from Japanese Patent Application No. 2008-284697 filed Nov. 5, 2008.

BACKGROUND

Technical Field

The present invention relates to a transport member for powder transport, a developing powder accommodation container, and an image forming apparatus.

SUMMARY

A technical object of the present invention is to improve restorability from deformation caused by a force received at the time of transport of powder such as developing powder.

According to an aspect of invention, a transport member for a powder transport includes a revolving shaft, a transport part that extends in a helical shape relative to an axial direction of the revolving shaft, includes one end part with a free end and the other end part at an opposite side of the one end part, and transports a powder at the time of revolution of the revolving shaft, and one support part that supports the other end part of the transport part by being arranged with the revolving shaft, wherein the transport part is not supported by another support part that is arranged at an phase angle between the one support part and the another support part of 90 degrees or more, in a direction of the revolving shaft.

According to the aspect of the invention, restorability from deformation caused by a force received at the time of transport of powder such as developing powder is improved in comparison with a case of employing a support part arranged with an interval of 90 degrees or greater from the support part for supporting the other end part of the helix transport part.

BRIEF DESCRIPTION OF THE DRAWINGS

Exemplary embodiments of the invention will be described in detail based on the following figures, wherein.

DETAILED DESCRIPTION

Figure 1:
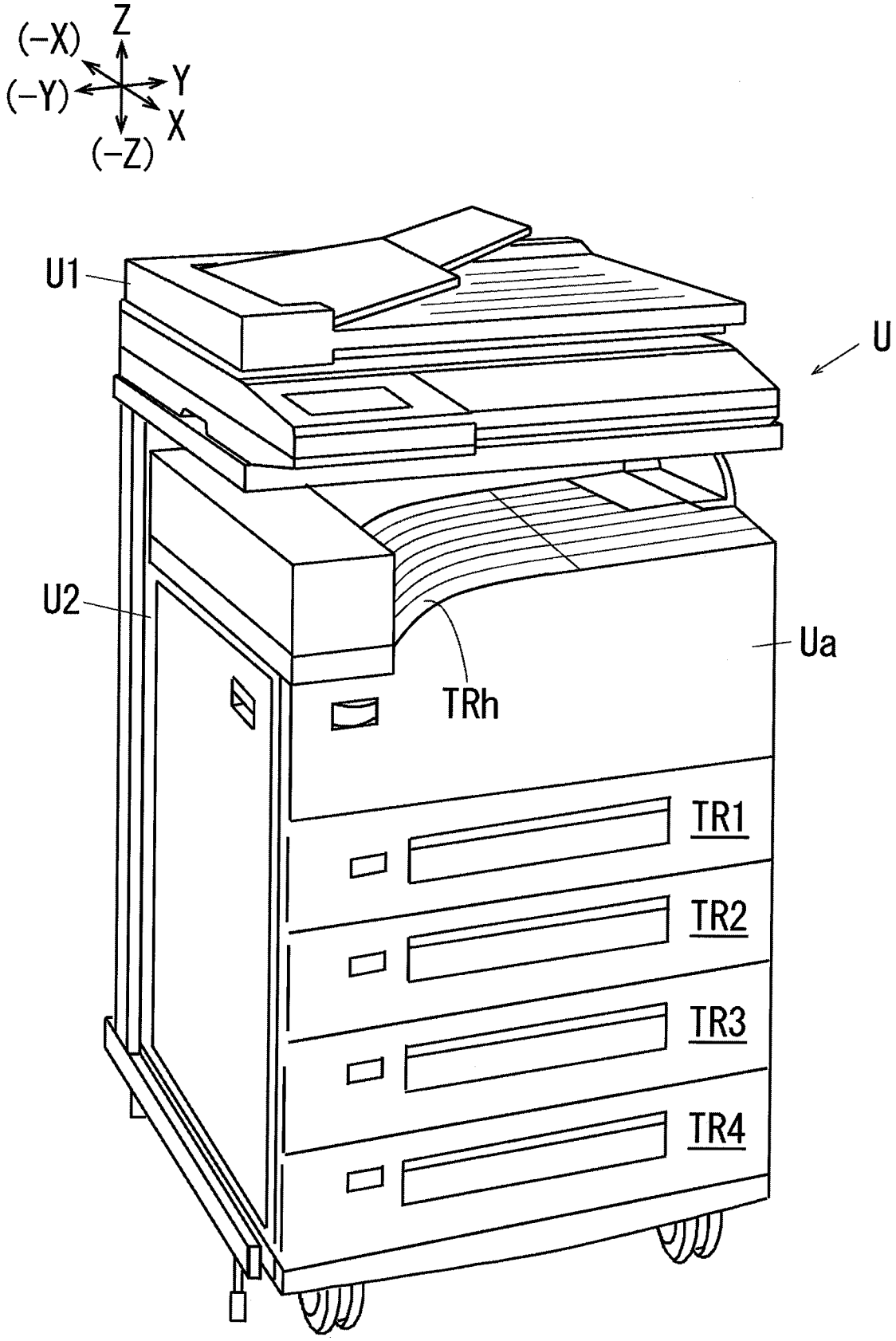
FIG. 1 is a perspective view showing an image forming apparatus according to Exemplary embodiment 1 of the present invention.

Next, exemplary embodiments that provide detailed examples of implementation of the present invention are described below with reference to the drawings. However, the present invention is not limited to the following exemplary embodiments.

For simplicity of the following description, in the drawings, the frontward and rearward directions are defined as the X-axis directions, the right and left directions are defined as the Y-axis directions, and the up and down directions are defined as the Z-axis directions. Then, these directions or sides indicated by arrows X, −X, Y, −Y, Z, and −Z are respectively referred to as frontward, rearward, rightward, leftward, upward, and downward, or front side, rear side, right-hand side, left-hand side, upside, and downside.

Further, in the figures, a symbol "○" having a dot "•" in the center represents an arrow directed from the behind of the page to the front side of the page, while a symbol "○" having a cross "x" in the center represents an arrow directed from the front side of the page to the behind of the page.

Here, in the following description with reference to the drawings, for simplicity of understanding, members other than those necessary in description are appropriately omitted in the figures.

Exemplary Embodiment 1

FIG. 1 is a perspective view showing an image forming apparatus according to Exemplary embodiment 1 of the present invention.

In FIG. 1, a copying machine U serving as an image forming apparatus according to Exemplary embodiment 1 of the present invention has: an auto document feeder U1 arranged in a top end part; and an image forming apparatus body U2 that supports the auto document feeder U1. In an upper part of the image forming apparatus body U2, a paper ejection tray TRh is provided that serves as an example of a medium ejection part. Further, in a lower part of the image forming apparatus body U2, plural of paper feed trays TR1 to TR4 that serve as examples of medium accommodation containers and that accommodate sheets serving as examples of media are provided in an attachable and detachable manner. In an upper front of the image forming apparatus body U1, a front cover Ua is supported that serves as an example of a front open-close member.

Figure 2:
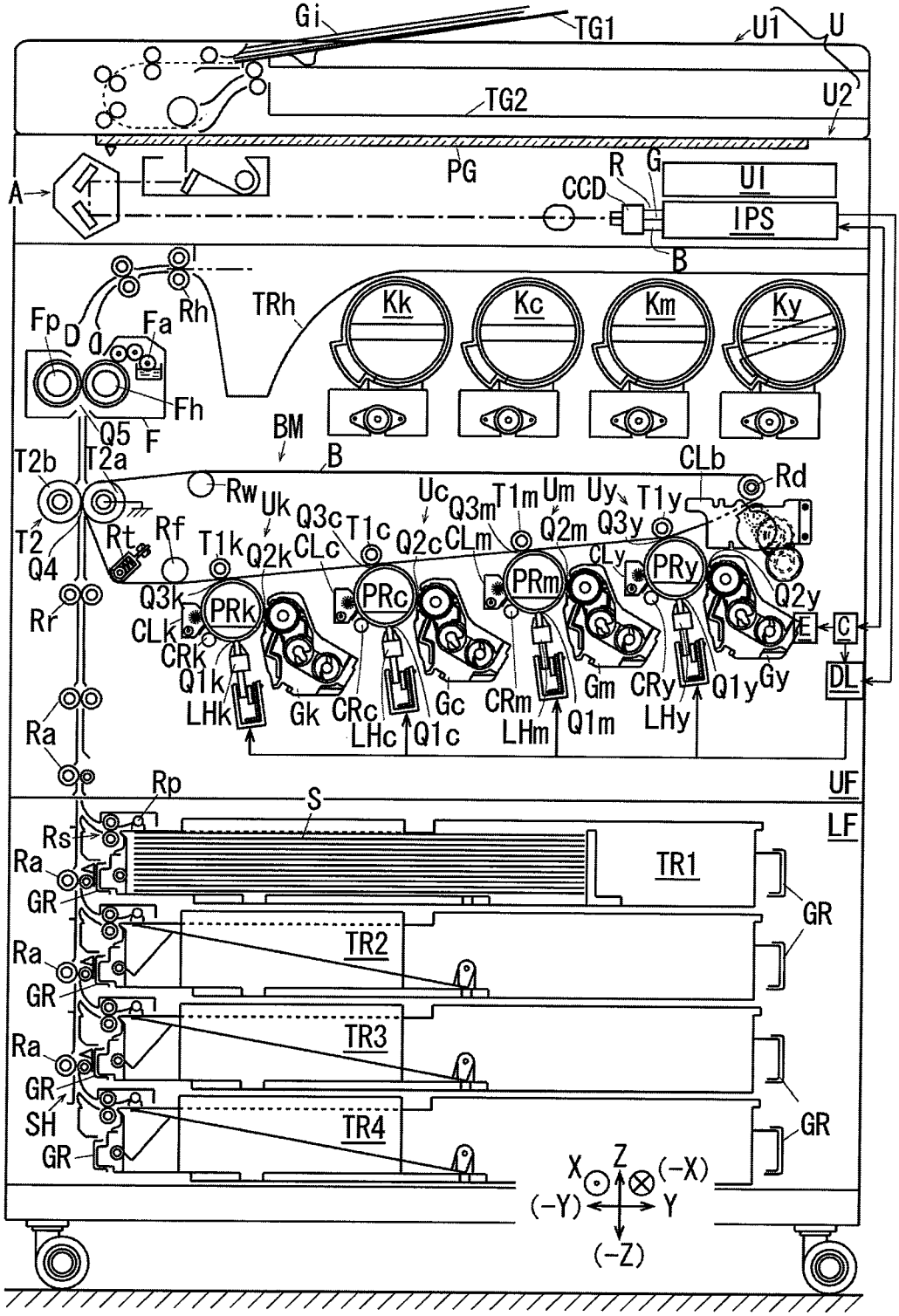
FIG. 2 is an explanation diagram showing the entirety of an image forming apparatus according to Exemplary embodiment 1 of the present invention.

FIG. 2 is an explanation diagram showing the entirety of the image forming apparatus according to Exemplary embodiment 1 of the present invention.

In FIG. 2, the auto document feeder U1 has: a manuscript feeding unit TG1 for accommodating a stack of plural of manuscripts Gi to be copied; and a manuscript ejection unit TG2 into which each manuscript Gi that is fed from the manuscript feeding unit TG1 and then transported via a transparent manuscript reading position on a manuscript reading surface PG at the upper end of the image forming apparatus body U2 is ejected.

The image forming apparatus body U2 has: an operation section UI through which a user inputs operation command signals such as an image formation operation start signal; and an exposure optical system A.

Light reflected from a manuscript transported along the manuscript reading surface PG by the auto document feeder U2 or alternatively from a manuscript manually placed on the manuscript reading surface PG is converted into electric signals of red (R), green (G), and blue (B) by a solid-state image sensor CCD via the exposure optical system A.

An image information conversion unit IPS converts into image information of black (K), yellow (Y), magenta (M), and cyan (C) the electric signals of RGB inputted from the solid-state image sensor CCD, then stores the information temporarily, and then outputs the stored image information as image information for latent image formation to the latent image forming apparatus drive circuit DL at a predetermined time.

Here, when the manuscript image is of single color, that is, so-called monochrome, the image information of black alone is inputted to the latent image forming apparatus drive circuit DL.

The latent image forming apparatus drive circuit DL has drive circuits (not shown) for individual colors Y, M, C, and K. Then, these drive circuits output signals corresponding to the inputted image information to latent image forming apparatuses LHy, LHm, LHc, and LHk for individual colors at a predetermined time.

Figure 3:
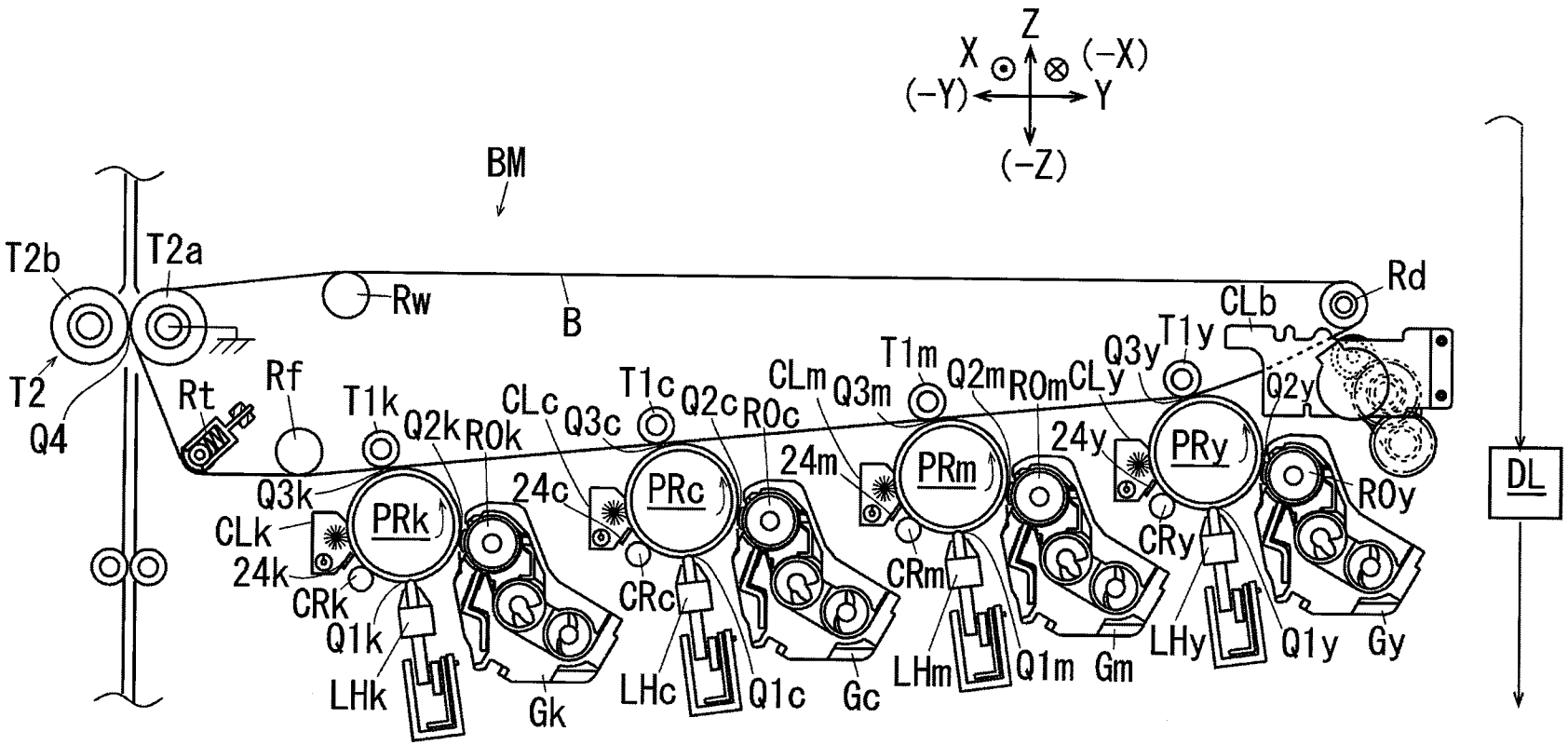
FIG. 3 is an explanation diagram showing a magnified view of the main part of an image forming apparatus according to Exemplary embodiment 1.

FIG. 3 is an explanation diagram showing a magnified view of the main part of the image forming apparatus according to Exemplary embodiment 1.

Visible image formation apparatuses Uy, Um, Uc, and Uk arranged in the center part in the gravitational direction of the image forming apparatus U serve individually as apparatuses for forming visible images for individual colors Y, M, C, and K.

Latent image writing light of Y, M, C, and K emitted from individual latent image writing light sources of the latent image forming apparatuses LHy to LHk are respectively incident on the revolving image carriers PRy, PRm, PRc, and PRk. Here, in Exemplary embodiment 1, the latent image forming apparatuses LHy to LHk are constructed from so-called LED arrays.

The visible image formation apparatus Uy for Y has a revolving image carrier PRy, an electrostatic charger CRy, a latent image forming apparatus LHy, a developing apparatus Gy, a transfer device T1*y*, and an image carrier cleaning device CLy. Here, in Exemplary embodiment 1, the image carrier PRy, the electrostatic charger CRy, and the image carrier cleaning device CLy are constructed in the form of an image carrier unit that can integrally be attached to and detached from the image forming apparatus body U2.

The visible image formation apparatuses Um, Uc, and Uk are constructed similarly to the visible image formation apparatus Uy for Y.

In FIGS. 2 and 3, the image carriers PRy, PRm, PRc, and PRk are electrostatically charged respectively by the electrostatic chargers CRy, CRm, CRc, and CRk. Then, at image writing positions Q1*y*, Q1*m*, Q1C, and Q1*k*, electrostatic latent images are formed in the surfaces with latent image writing light beams Ly, Lm, Lc, and Lk. Then, in developing areas Q2*y*, Q2*m*, Q2C, and Q2*k*, the electrostatic latent images on the surfaces of the image carriers PRy, PRm, PRc, and PRk are developed into toner images serving as examples of visible images, with developing powder held on developing rolls ROy, ROm, ROc, and ROk serving as examples of developing powder holders of the developing apparatuses Gy, Gm, Gc, and Gk.

The developed toner images are transported to primary transfer regions Q3*y*, Q3*m*, Q3*c*, and Q3*k* that contact with an intermediate transfer belt B serving as an example of an intermediate transfer body. In the primary transfer regions Q3*y*, Q3*m*, Q3*c*, and Q3*k*, a primary transfer voltage having a polarity opposite to the electrification polarity of the toner is applied onto the primary transfer devices T1*y*, T1*m*, T1*c*, and T1*k* arranged on the rear face side of the intermediate transfer belt B, at a predetermined time from a power supply circuit E controlled by a control unit C.

The toner images on the image carriers PRy to PRk are primary-transferred onto the intermediate transfer belt B by the primary transfer devices T1*y*, T1*m*, T1*c*, and T1*k*. Residue and adhering materials on the surfaces of the image carriers PRy, PRm, PRc, and PRk after the primary transfer are cleaned by the image carrier cleaning devices CLy, CLm, CLc, and CLk. The cleaned surfaces of the image carriers PRy, PRm, PRc, and PRk are electrostatically re-charged by the electrostatic chargers CRy, CRm, CRc, and CRk.

Above the image carriers PRy to PRk, a belt module BM is arranged that can be moved vertically and extracted frontward and that serves as an example of an intermediate transfer apparatus. The belt module BM has: the intermediate transfer belt B; a belt driving roll Rd serving as an example of an intermediate transfer body driving member; a tension roll Rt serving as an example of an intermediate transfer body extending member; a walking roll Rw serving as an example of a meandering prevention member; an idler roll Rf serving as an example of a follower member; a back-up roll T2*a* serving as an example of a secondary transfer region opposing member; and the primary transfer devices T1*y*, T1*m*, T1*c*, and T3*k*. Then, the intermediate transfer belt B is supported in a revolvable manner by belt support rolls Rd, Rt, Rw, Rf, and T2*a* serving as an example of an intermediate transfer body support members constructed from the individual rolls Rd, Rt, Rw, Rf, and T2*a*.

In a state of opposing the surface of the intermediate transfer belt B that contacts with the back-up roll T2*a*, a secondary transfer roll T2*b* is arranged that serves as an example of a secondary transfer member. Then, the rolls T2*a* and T2*b* constitute a secondary transfer device T2. Further, a secondary transfer region Q4 is formed in a region where the secondary transfer roll T2*b* and the intermediate transfer belt B oppose each other.

The monochrome or multicolor toner image obtained by sequentially transferring and stacking on the intermediate transfer belt B by the primary transfer devices T1*y*, T1*m*, T1*c*, and T1*k* in the primary transfer regions Q3*y*, Q3*m*, Q3*c*, and Q3*k* is transported to the secondary transfer region Q4.

Below the visible image formation apparatuses Uy to Uk, four steps of guide rails GR are provided each of which is composed of a pair of left and right guide rails serving as an example of guide members. The guide rails GR support the paper feed trays TR1 to TR4 in a manner permitting insertion and extraction in the frontward and rearward directions. A sheet S accommodated in the paper feed trays TR1 to TR4 is extracted by a pick up roll Rp serving as an example of a medium extracting member, and then separated individually by a shuffling roll Rs serving as an example of a medium shuffling member. Then, the sheet S is transported along a sheet transport path SH serving as an example of a medium transport path by plural of transport rolls Ra that is arranged in the upstream of the secondary transfer region Q4 relative to the sheet transporting direction and that serves as examples of medium transport members, and then sent to a resistance roll Rr serving as an example of a transfer region transport time adjusting member. The sheet transport path SH, sheet transporting roll Ra, the resistance roll Rr, and the like constitute a sheet transport apparatus SH+Ra+Rr.

In synchronization with the time that the toner image formed on the intermediate transfer belt B is transported to the secondary transfer region Q4, the resistance roll Rr transports the sheet S to the secondary transfer region Q4. When the sheet S passes through the secondary transfer region Q4, the back-up roll T2*a* is grounded, while a secondary transfer voltage having a polarity opposite to the electrification polarity of the toner is applied onto the secondary transfer device T2 from the power supply circuit E controlled by the control unit C. At that time, the toner image on the intermediate transfer belt B is transferred onto the sheet S by the secondary transfer device T2.

The intermediate transfer belt B after the secondary transfer is cleaned by a belt cleaner CLb serving as an example of an intermediate transfer body cleaning device.

Thus, in the image forming apparatus U according to Exemplary embodiment 1, the primary transfer devices T1*y* to T1*k*, the intermediate transfer belt B, the secondary transfer device T2, and the like constitute a transfer apparatus T1+B+T2 for transferring the toner images on the surfaces of the image carriers PRy to PRk onto the sheet S.

The sheet S on which the toner image has been secondary-transferred is transported to a fixing area Q5 serving as a pressuring region formed by a heating roll Fh serving as an example of a fixing member for heating in the fixing apparatus F and a pressuring roll Fp serving as an example of a fixing member for pressurization. Then, heat fixing is performed during the time of passing through the fixing area. The sheet S having been processed by heat fixing is ejected from a discharge roll Rh serving as an example of a medium ejection member into the paper ejection tray TRh serving as an example of a medium ejection part.

Here, mold-releasing agent for improving the releasing of the sheet S from the heating roll is applied onto the surface of the heating roll Fh by a mold-releasing agent coating apparatus Fa.

Above the belt module BM, toner cartridges Ky, Km, Kc, and Kk are arranged that serve as examples of developing powder accommodation containers for accommodating developing powder of yellow Y, magenta M, cyan C, and black K and that serve as examples of developing powder accommodation containers for transporting and supplying internal developing powder to the image forming apparatus U. In accordance with consumption of the developing powder in the developing apparatuses Gy, Gm, Gc, and Gk, the developing powder accommodated in the toner cartridges Ky, Km, Kc, and Kk is supplied through developing powder supply paths (not shown) to the developing apparatuses Gy, Gm, Gc, and Gk. Here, in Exemplary embodiment 1, the developing powder is composed of two-component developing powder containing a magnetic carrier and a toner with external additive.

In FIG. 2, the image forming apparatus U has an upper frame UF and a lower frame LF. The upper frame UF supports: the visible image formation apparatuses Uy to Uk; and other members such as the belt module BM arranged above the visible image formation apparatuses Uy to Uk.

Further, the lower frame F supports: the guide rails GR for supporting the paper feed trays TR1 to TR4; and the paper feed members such as the pick up roll Rp, the shuffling roll Rs, and the sheet transporting roll Ra for feeding paper from the trays TR1 to TR3.

(Description of Toner Cartridge and Cartridge Attachment Part)

Figure 4:
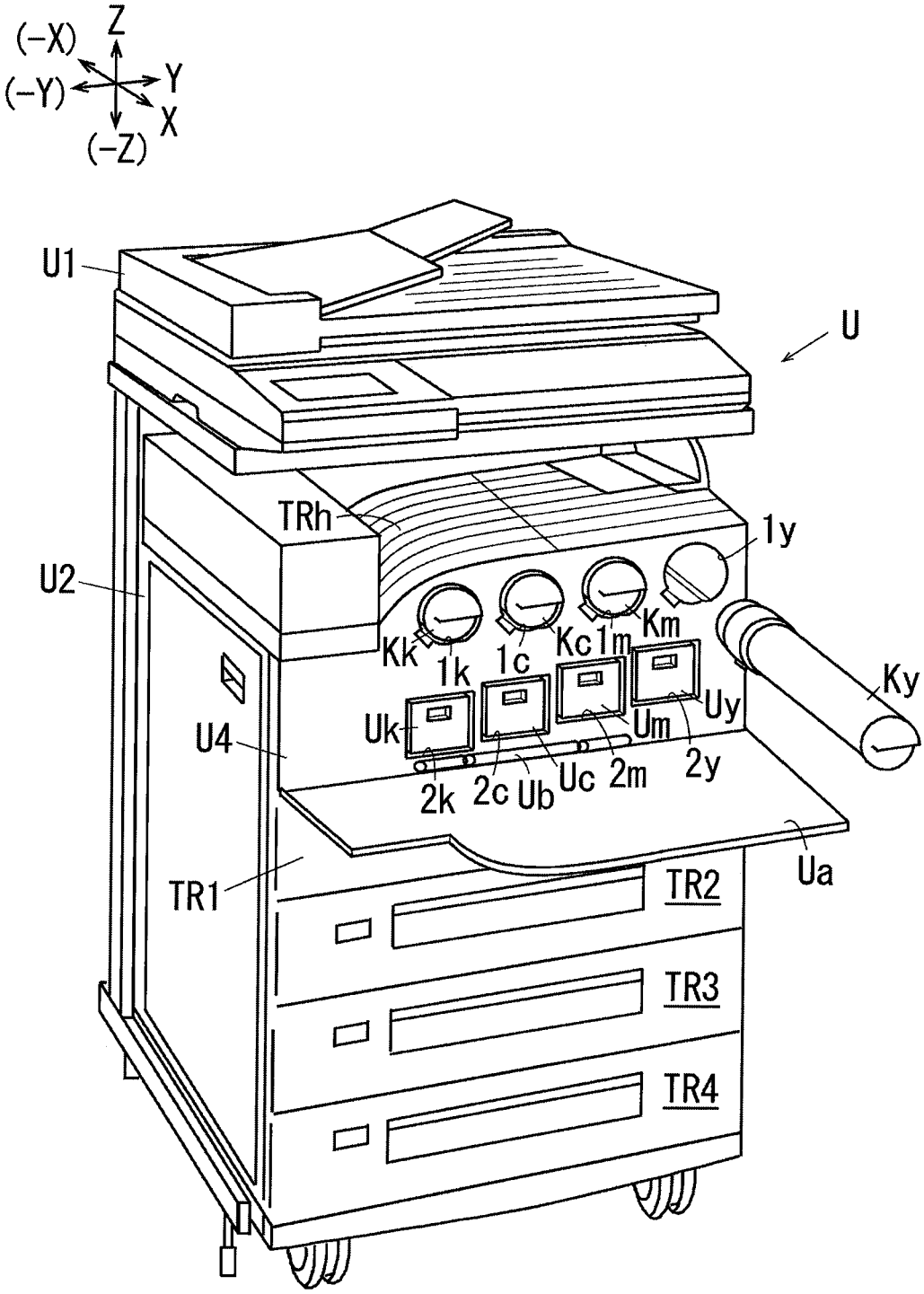
FIG. 4 is an explanation diagram showing a state that a front cover of an image forming apparatus according to Exemplary embodiment 1 is opened and then a toner cartridge for yellow is removed.

FIG. 4 is an explanation diagram showing a state that the front cover of the image forming apparatus according to Exemplary embodiment 1 is opened and then the toner cartridge for yellow is removed.

In FIGS. 1 and 4, the front cover Ua of the copying machine U is supported on the image forming apparatus body U1 in a revolvable manner by a hinge Ub. Thus, the front cover Ua is supported in a revolvable manner between a normal position adopted at the time of execution and waiting of image formation operation as shown in FIG. 1 and a maintenance service position adopted when maintenance services such as replacement of the toner cartridges Ky to Kk or the visible image formation apparatuses Uy, Um, Uc, and Uk as shown in FIG. 4.

In FIG. 4, the front cover Ua supports, in its inside, a front panel U4 serving as an example of a front member of the image forming apparatus body U1. In the front panel U4, cylindrical-hole-shaped toner cartridge attachment parts 1*y*, 1*m*, 1*c*, and 1*k* are formed which serve as examples of supply container attachment parts and into or from which cylindrical toner cartridges Ky to Kk for individual colors are inserted or removed so that attachment or detachment is achieved. Further, in the front panel U4, process cartridge attachment parts 2*y*, 2*m*, 2*c*, and 2*k* are formed which serve as examples of attachment parts for visible image formation apparatuses and into or from which the visible image formation apparatuses Uy to Uk are inserted or removed so that attachment or detachment is achieved.

Figure 5:
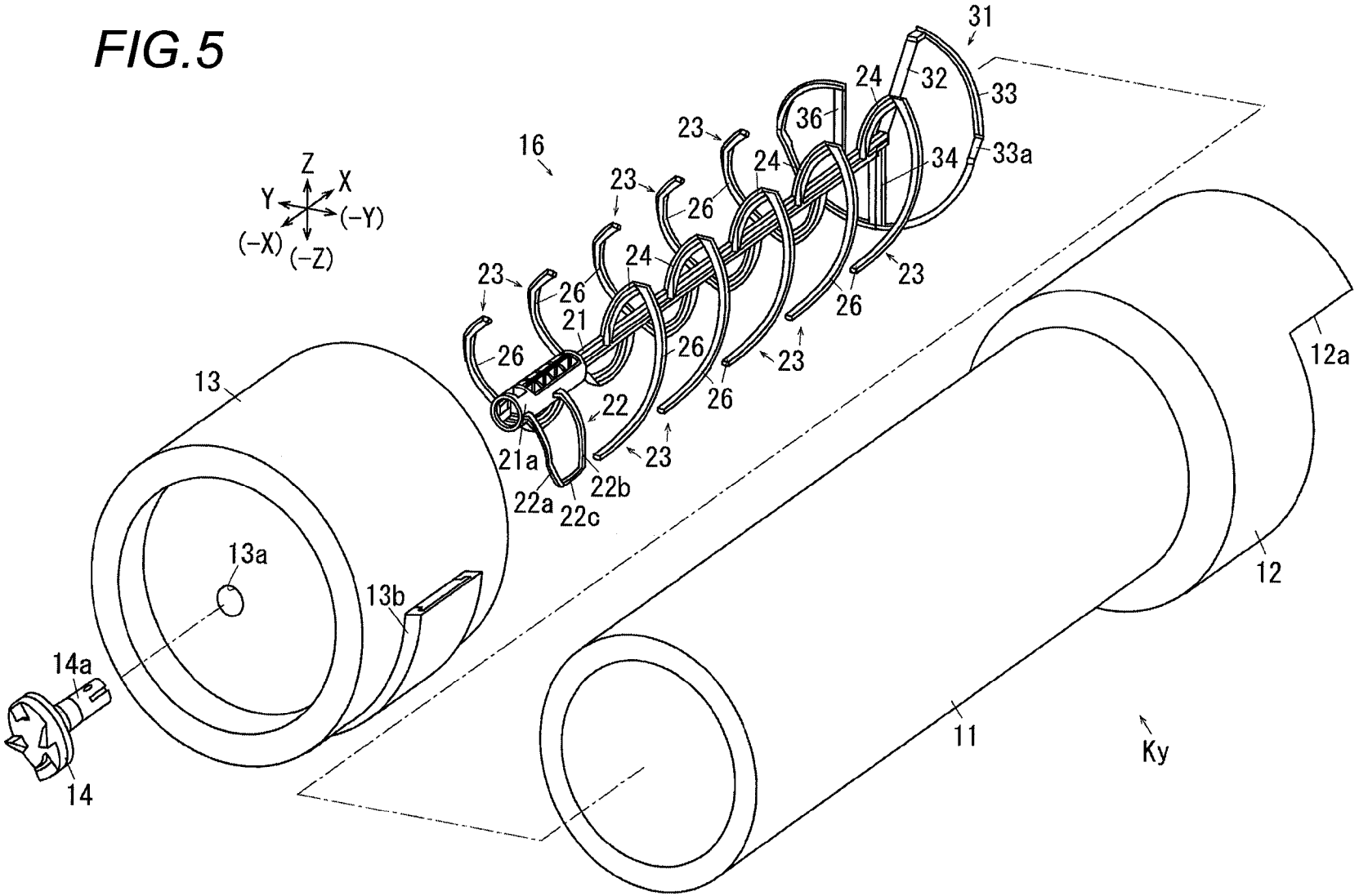
FIG. 5 is an explanation diagram showing the main part of a toner according to the present Exemplary embodiment 1.

FIG. 5 is an explanation diagram showing the main part of the toner according to the present Exemplary embodiment 1.

Here, the toner cartridges Ky to Kk for individual colors are constructed similarly to each other. Thus, in the following description, the toner cartridge Ky for yellow Y is described in detail. Then, detailed description for the other toner cartridges Km, Kc, and Kk is omitted.

In FIGS. 4 and 5, the toner cartridge Ky has a cartridge body 11 that serves as an example of a developing powder accommodation part and that serves as an example of a container body. The cartridge body 11 is formed in the shape of an approximate cylinder extending in the frontward and rearward directions, and accommodates, in its inside, developing powder serving as an example of powder. The front end part of the cartridge body 11 supports a front cover 12 serving as an example of a container front end member. In the front cover 12, a grip part 12*a* is formed that is to be gripped by a user when the toner cartridge Ky is to be replaced.

In FIG. 5, the rear end part of the cartridge body 11 supports a rear cover 13 serving as an example of a container rear end member. At the rear end of the rear cover 13, a support hole 13*a* is formed that serves as an example of a to-be-driven transfer member support part. In the lower left part of the outer peripheral surface of the rear cover 13, a service opening (not shown) is formed that serves as an example of a flow-out part through which developing powder in the cartridge body 11 flows out. In the service opening, a shutter 13*b* is provided that serves as an example of an open-close member moved so as to be opened or closed when the toner cartridge Ky is to be attached to or detached from the image forming apparatus body U1.

The support hole 13*a* supports a shaft 14*a* of a to-be-driven coupling 14 serving as an example of a to-be-driven transfer member, in a revolvable manner in a state of penetrating through. When attached to the image forming apparatus body U1, the to-be-driven coupling 14 engages with a drive coupling (not shown) that serves as an example of a driving transmission member arranged in the image forming apparatus body U1, so that the driving is transmitted. Here, the drive coupling or to-be-driven coupling are described, for example, in JP-A-2004-252184, JP-A-2005-134452, and JP-A-No. 2005-181515, and hence publicly known. Thus, their illustration and detailed description are omitted.

Figure 6:
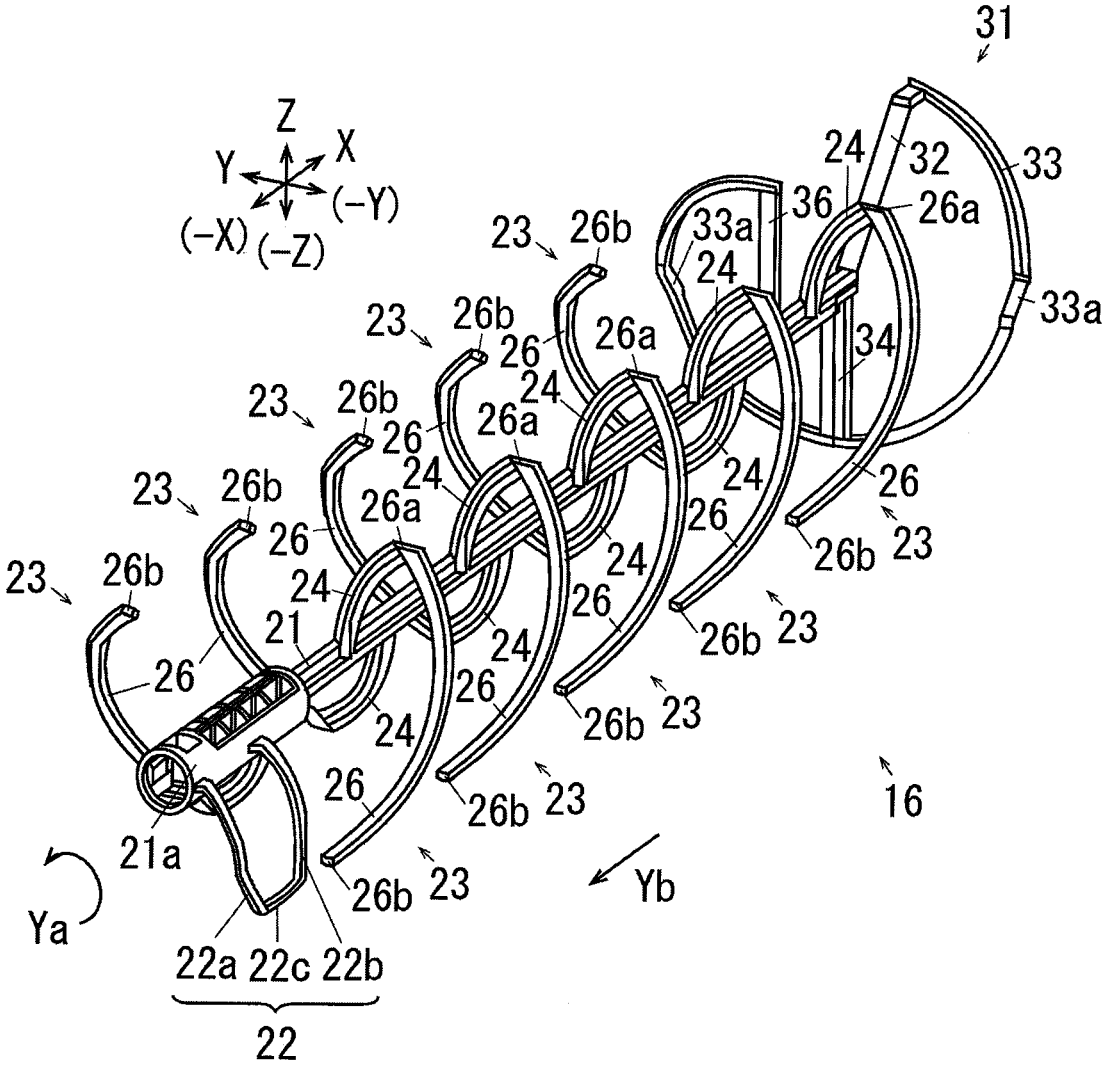
FIG. 6 is a perspective view showing a transport member according to Exemplary embodiment 1.

FIG. 6 is a perspective view showing the transport member according to Exemplary embodiment 1.

Figures 7A, 7B, 7C, 7D, 7E:
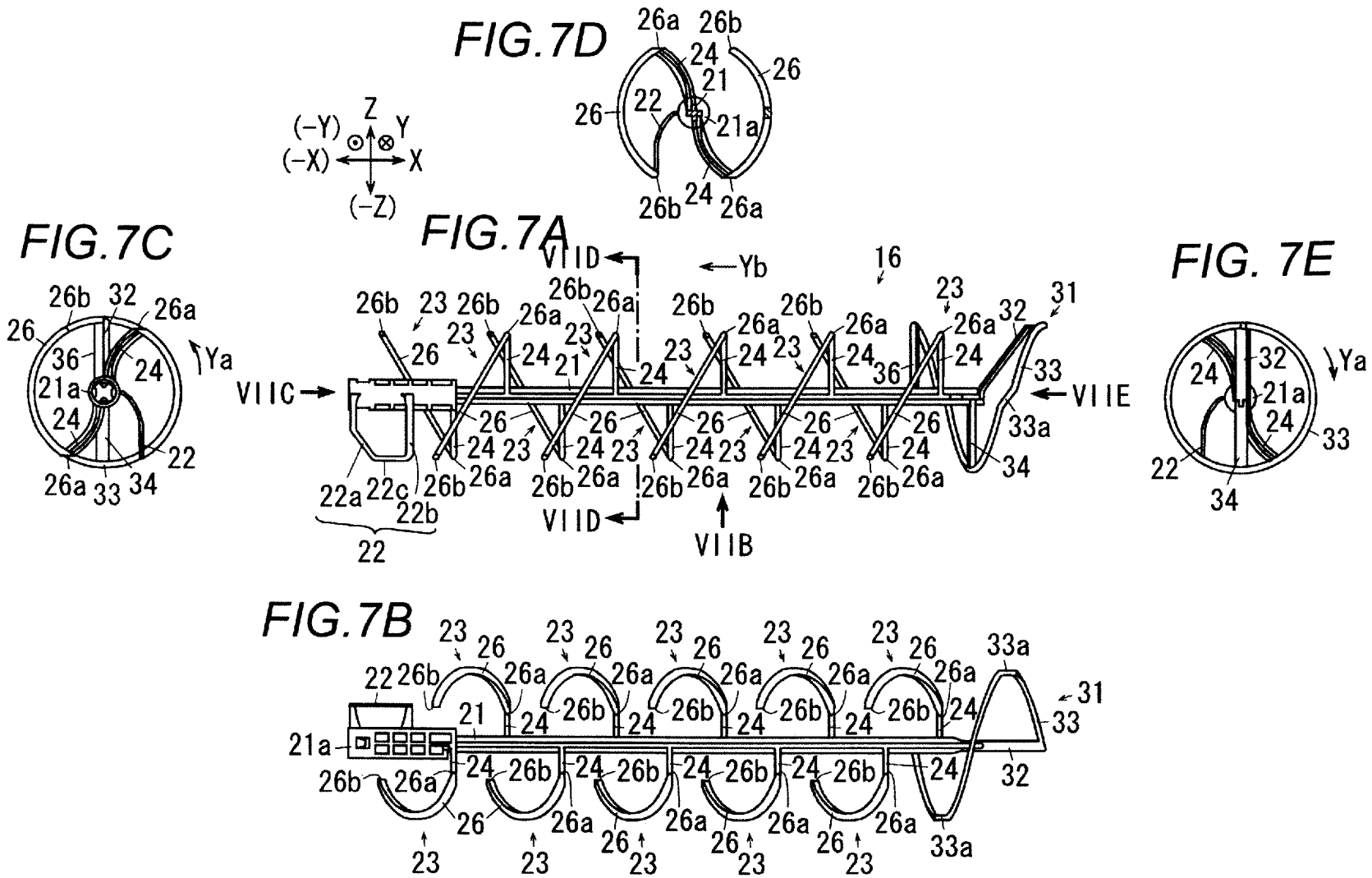
FIG. 7A is a side view of an explanation diagram showing a transport member according to Exemplary embodiment 1.
FIG. 7B shows a view from an arrow VIIB direction in FIG. 7A.
FIG. 7C shows a view from an arrow VIIC direction in FIG. 7A.
FIG. 7D shows a sectional view taken along line VIID-VIID in FIG. 7A.
FIG. 7E shows a view from an arrow VIIE direction in FIG. 7A.

FIG. 7A is a side view of an explanation diagram showing the transport member according to Exemplary embodiment 1. FIG. 7B shows a view from an arrow VIIB direction in FIG. 7A. FIG. 7C shows a view from an arrow VIIC direction in FIG. 7A. FIG. 7D shows a sectional view taken along line VIID-VIID in FIG. 7A. FIG. 7E shows a view from an arrow VIIE direction in FIG. 7A.

Figure 8:
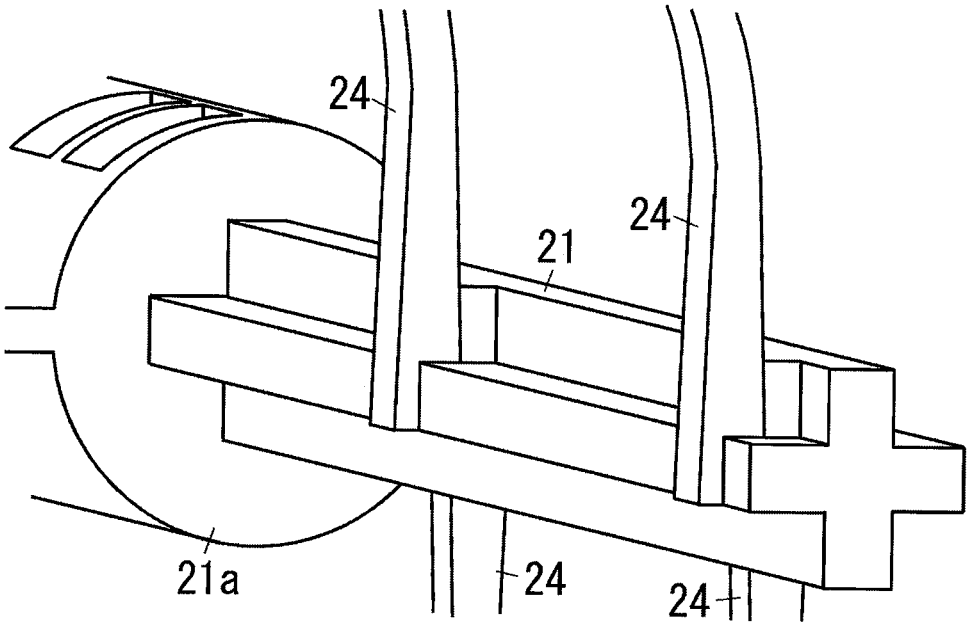
FIG. 8 is an explanation diagram showing the main part of a boundary part between a support part and a revolving shaft according to Exemplary embodiment 1.

FIG. 8 is an explanation diagram showing the main part of a boundary part between the support part and the revolving shaft according to Exemplary embodiment 1.

In FIGS. 5 and 6, the cartridge body 11 accommodates, in its inside, the agitator 16 serving as an example of an agitating member and an example of a transport member. In FIGS. 5 to 7, the agitator 16 according to Exemplary embodiment 1 has a shaft 21 that serves as an example of a revolving shaft and extends the frontward and rearward directions. In FIGS. 7D and 8, the shaft 21 according to Exemplary embodiment 1 is formed in a cross shape when viewed in a cross section.

At the rear end of the shaft 21, a coupling linkage part 21*a* is formed which serves as an example of a drive connection section and to which the shaft 14*a* of the to-be-driven coupling 14 is linked.

In FIG. 6 and FIG. 7A, when developing powder in the cartridge body 11 is to be transported toward the service opening, the shaft 21 according to Exemplary embodiment 1 receives the driving transmitted via the to-be-driven coupling 14 and the like, and thereby revolves in the revolution direction indicated by an arrow Ya in FIG. 7A.

In the outer periphery of the coupling linkage part 21*a*, a flow-out opening agitating member 22 is integrally formed that serves as an example of a flow-out opening transport member. The flow-out opening agitating member 22 has service opening agitation support parts 22*a* and 22*b* that serve as an example of a pair of front and rear flow-out part agitation support parts extending in the radial direction. Then, in FIG. 7C, the service opening agitation support parts 22*a* and 22*b* extend in a radial direction with curving toward the downstream relative to the revolution direction Ya of the agitator 16. Then, the outer end part in the radial direction is linked by a service opening agitating part 22*c* that serves as an example of a flow-out part agitating part and that extends in the frontward and rearward directions. Here, the rear-side service opening agitation support part 22*a* according to Exemplary embodiment 1 is formed in a shape such as to be bent rearward starting at the center part in the radial direction.

In the part between the front end part in the axial direction of the coupling linkage part 21*a* and the front end part of the shaft 21, plural of helical members 23 are formed that serve as an example of a transport member body. The helical members 23 are arranged at positions that have predetermined intervals to each other in the axial direction of the shaft 21 and that have a phase deviation of 180 degrees with each other in the revolution direction Ya of the shaft 21.

Each helical member 23 has a support part 24 extending in a radial direction. The support part 24 according to Exemplary embodiment 1 extends in a radial direction with curving toward the downstream relative to the revolution direction Ya of the agitator 16. In FIG. 8, in a base end part 24*a* where the support part 24 according to Exemplary embodiment 1 is supported by the shaft 21, the width of the support part 24 is formed longer than one side of the cross of the cross-shaped shaft 21. This increases rigidity and reduces deformation in comparison with a case of being shorter than or equal to one side of the cross.

In FIGS. 6 and 7, in the outer edge in the radial direction of the support part 24, transport parts 26 are integrally formed that have the shape of a helix in the axial direction of the shaft 21, that is, the shape of arcs extending along the helix. Here, the transport part 26 according to Exemplary embodiment 1 has a capability of agitating and transporting developing powder, and hence has the function of an agitating part. The transport part 26 has an other end part 26*a* supported by the support part 24; and one end part 26*b* located on the side opposite to the arc. The one end part 26*b* is in the form of a free end. That is, the transport part 26 and the support part 24 according to Exemplary embodiment 1 are supported by the shaft 21 in a cantilever state that the base end part of the support part 24 is supported by the shaft 21. Here, in the transport part 26 according to Exemplary embodiment 1, its outer diameter is set smaller than the diameter of the inner peripheral surface of the cartridge body 11. Thus, in a state that the support part 24 and the transport part 26 are not deformed, a gap is formed such that these parts are not contact with the inner peripheral surface of the cartridge body 11.

As shown in FIG. 7A, the transport part 26 is formed in a shape inclined toward the rear side in the axial direction of the shaft 21, that is, toward the downstream in the developing powder transport direction, when viewed from the side surface. In FIGS. 7C to 7E, in the transport part 26 according to Exemplary embodiment 1, the central angle about the shaft 21 is set to be 140 degrees or the like. A central angle smaller than or equal to 360 degrees is better, and a central angle greater than or equal to 90 degrees and smaller than or equal to 180 degrees is much better. When an angle greater than 360 degrees is adopted, at the time of deformation of the support part 24 and the transport part 26 caused by a reactive force from developing powder under transport, an increase is caused in the spread, the deformation, and the inclination of the helix. This causes an increase in the possibility of contacting with the inner peripheral surface of the cartridge body 11. In particular, when contact with the inner peripheral surface of the cartridge body 11 is taken into consideration, an angle smaller than or equal to 180 degrees is better. In contrast, an excessively small central angle is adopted, insufficiency can be caused in the transport force for developing powder. Further, when an increased number of transport parts 26 is adopted in order to ensure the transport force, difficulty can be caused in molding. Thus, an angle greater than or equal to 90 degrees is better. As a result, in FIG. 7D, in the transport part 26, a gap having a central angle of 40 degrees about the shaft 21 is formed between the other end part 26*a* of each transport part 26 and one end part 26*b* of the adjacent transport part 26.

In the front end part of the shaft 21, a front-side helical member 31 is provided that serve as an example of an upstream-end transport member. The front-side helical member 31 has a front-side inclination support part 32 extending in a radial direction and in the frontward direction from the shaft 21. The outer edge of the front-side inclination support part 32 has an upstream agitating part 33 that extends in a helical shape about the shaft 21 and that serves as an example of an upstream transport part. The upstream agitating part 33 according to Exemplary embodiment has a central angle of 360 degrees. At a position where the phase of the central angle increases by the 180 degrees rearward from the front-side inclination support part 32, the upstream agitating part 33 is linked to the shaft 21 by a first radial direction support part 34 that extends in a radial direction from the shaft 21. Further, at a position where the phase increases by 360 degrees, the upstream agitating part 33 is linked to the shaft 21 by a second radial direction support part 36 that extends in a radial direction from the shaft 21.

In FIGS. 6 and 7A, in the upstream agitating part 33 according to Exemplary embodiment 1, at positions where the phase of the central angle increases by 90 degrees and by 270 degrees from the front-side inclination support part 32, moderate inclination parts 33*a* having moderate inclination relative to the revolving shaft are formed in order that transport property should be reduced and agitation property should be improved and that easy extraction should be realized in the process of molding.

Here, the agitator 16 according to Exemplary embodiment 1 is fabricated by integral molding of a resin material having a lower rigidity than metallic materials such as stainless steel. Here, the employed resin material may be an arbitrary in accordance with the design, the specification, and the like. For example, employable resin materials include PP (polypropylene), HDPE (high-density polyethylene), PA (nylon)(polyamide), ABS (acrylonitrile-butadiene-styrene copolymer), PPE alloy (polyphenylene ether alloy), and POM (polyacetal). In particular, POM is suitably employed in which deformation caused by a torque load is recovered easily.

Operation of Exemplary Embodiment 1

In the image forming apparatus U having the above-mentioned configuration according to Exemplary embodiment 1, when developing powder is consumed in association with image formation operation, developing powder is supplied from the toner cartridges Ky to Kk. When the operation of supplying the developing powder is started, the agitator 16 composed of resin arranged in each of the toner cartridges Ky to Kk revolves in the revolution direction Ya for a predetermined time. When the agitator 16 revolves, the helix transport part 26 agitates and breaking down the developing powder in the cartridge body 11, and transports the developing powder toward the downstream of the transport direction, that is, toward the rear service opening. The developing powder transported to the service opening flows into the image forming apparatus body U1, and is then transported through the inside of the image forming apparatus body U1 so as to be supplied to the developing apparatuses Gy to Gk.

In the toner cartridges Ky to Kk according to Exemplary embodiment 1, when the agitator 16 composed of resin revolves, the transport part 26 receives a force as the reaction of the operation that the transport part 26 pushes and transports the developing powder rearward. Thus, the transport part 26 is deformed.

For example, a so-called coil-shaped metal agitator having been wound in a helical shape is replaced by that composed of resin, the helix of the agitator is spread owing to its insufficient strength so that the agitator contacts with and rubs against the inner wall surface of the cartridge body 11. This causes the problem of an increase in the driving force, that is, a so-called torque, necessary for driving the agitator. Further, the contact with the inner wall surface of the cartridge body 11 causes a possibility that the deformation results in permanent bending or breakage. Meanwhile, for the purpose of reinforcing the helical agitator, a large number of support parts may be provided that extend from the shaft toward the agitator in the radial direction. Nevertheless, even in this case, the spread of the helix cannot sufficiently be suppressed. Thus, contact with the inner wall surface of the cartridge body 11 causes a high torque.

In contrast, in the agitator 16 according to Exemplary embodiment 1, when the transport part 26 receives a reactive force, the transport part 26 formed in a cantilever state and having one end part 26*b* constructed as a free end is deformed such as to divert or redirect the force.

Accordingly, in Exemplary embodiment 1, even when the agitator 16 is fabricated from a resin material having a lower strength than metals, an agitator 16 is realized and obtained that does not cause an excessive transport resistance and an excessive driving torque and that has damage resistance, a reduced raw material cost, and a reduced production cost in mass production.

Further, in the agitator 16 that easily redirects the force and hence has a reduced transport resistance, plastic deformation in the transport part 26 at the time of load is reduced. Thus, when the load of developing powder disappears, the shape is easily restored by elastic restoration. Accordingly, in comparison with the prior art configuration, the agitator 16 according to Exemplary embodiment 1 has improved restorability from deformation caused by a force received at the time of transport of developing powder. That is, a situation is suppressed that plastic deformation in the agitator 16 increases in association with the progresses of time so as to cause a change in the transport performance for developing powder.

Figure 9B:
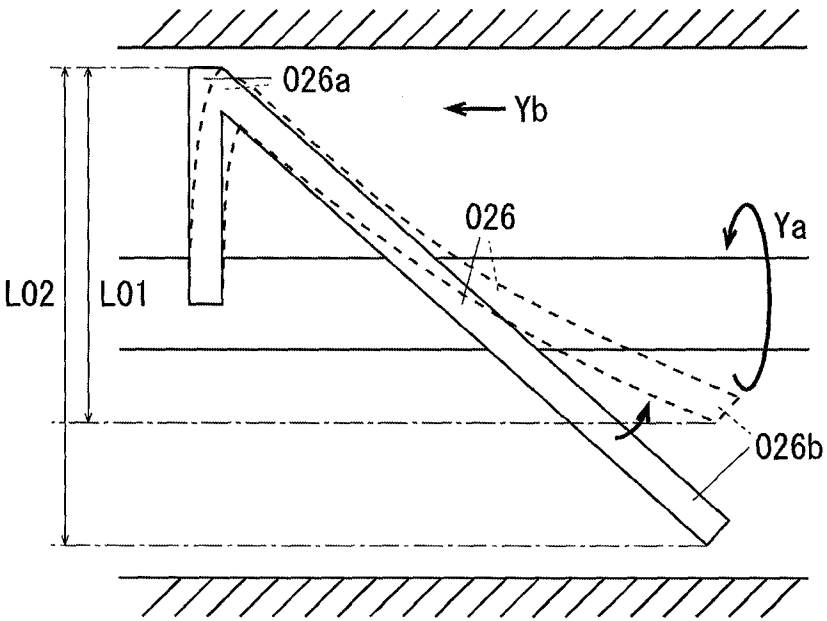
FIG. 9B is an explanation diagram showing deformation and transport performance in a case that a transport part extends toward the upstream.
Figure 9A:
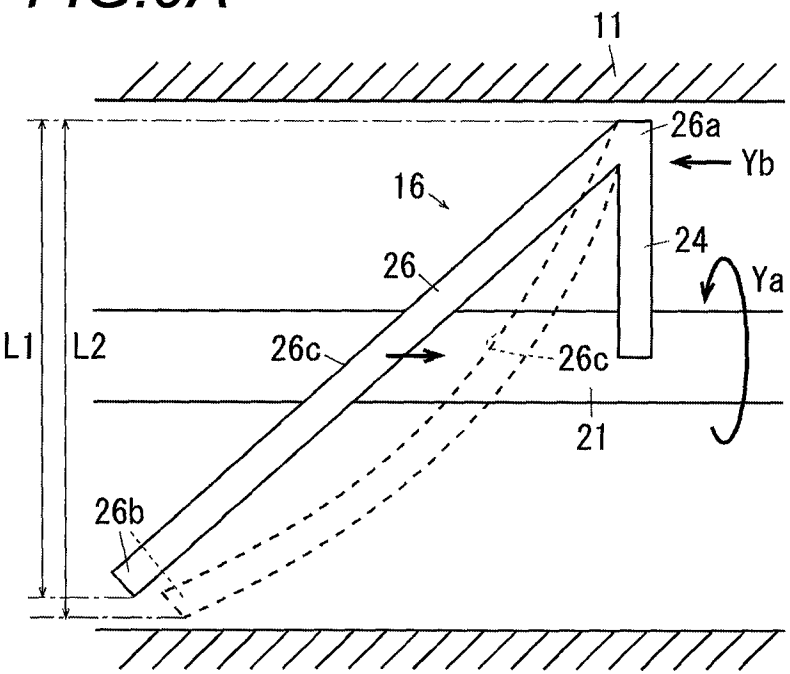
FIG. 9A is an explanation diagram showing deformation and transport performance in a case that a transport part extends toward the downstream as in Exemplary embodiment 1.

FIG. 9 is an explanation diagram showing deformation and transport performance of the transport part. FIG. 9A is an explanation diagram showing deformation and transport performance in a case that the transport part extends toward the downstream as in Exemplary embodiment 1. FIG. 9B is an explanation diagram showing deformation and transport performance in a case that the transport part extends toward the upstream.

In FIGS. 6, 7, and 9A, in the agitator 16 according to Exemplary embodiment 1, the arc-shaped transport parts 26 arranged along the helix extend toward the downstream of the developing powder transport direction Yb. If the transport part 26 extends toward the upstream of the developing powder transport direction Yb as shown in FIG. 9B, the free one end part of the transport part 26 is deformed toward the base end as illustrated by a dashed line in FIG. 9B, owing to a force acting from developing powder onto the transport part 26 at the time of agitation and transport. In this case, as for the length measured from the other end part 26*a* to the one end part 26*b* of the transport part 26 when projected onto a cross section perpendicular to the axial direction, the length L2 with deformation is shorter than the length L1 without deformation. These lengths L1 and L2 correspond to the effective area for transporting the developing powder to the downstream. Thus, in the configuration shown in FIG. 9B, a possibility is present that the transport capability for developing powder is degraded in association with deformation.

In contrast, in the configuration according to Exemplary embodiment 1 shown in FIG. 9A, the transport part 26 is deformed by a force at the time of agitation transport of developing powder, the length L2 with deformation is longer than the length L1 without deformation. Thus, degradation in the transport capability for developing powder is suppressed. Further, in the front surface 26*c* of the transport part 26, the part that receives the force is inclined relative to the transport direction Yb before the deformation. In contrast, with deformation, the part that receives the force is almost perpendicular to the transport direction Yb. Thus, the capability of pushing and transporting the developing powder is improved.

Further, in Exemplary embodiment 1, the central angle of the arc of the transport part 26 is set to be 140 degrees or the like, and hence does not exceed 360 degrees. Thus, at the time of deformation, the amount of deformation in the one end part 26*b* of the transport part 26 is relatively small so that contact with the inner wall surface of the cartridge body 11 is suppressed. Accordingly, in comparison with a case that the central angle is greater and hence the amount of deformation is larger, noise and a torque increase are reduced that could be caused by the contact of the one end part 26*b* with the inner peripheral surface of the cartridge body 11.

Further, in the above-mentioned configuration, along the developing powder transport direction of the cartridge body 11, a larger amount of developing powder is distributed on the downstream side of the transport direction. Thus, the load acting on the transport part 26 decreases when the position moves toward the upstream of the transport direction. As a result, in the agitator 16 according to Exemplary embodiment 1, in the front-side helical member 31 arranged at the upstream end where the load is low and the possibility of breakage is low, the upstream agitating part 33 of 360 degrees is allowed to be arranged, and is supported by plural of support parts 32, 34, and 36 so that the spreading of the helix is suppressed at the time of deformation.

EXAMPLES

Next, experiments have been performed concerning deformation in the agitator 16 according to Exemplary embodiment 1. The experiments are simulations on a computer, that is, so-called computer simulations.

Example 1-1 is a simulation of the shapes without and with deformation and the von Mises stress acting on each part at each time for a model corresponding to the agitator 16 according to Exemplary embodiment 1 in a case that the rear end of the coupling linkage part 21*a* of the shaft 21 is freely revolvable but its movement in a plane perpendicular to the axial direction is constrained, that the revolution of the right and left outermost edges of each transport part 26 are constrained, and that a revolution load, that is, a torque, of 100 [N·cm] is applied on the shaft 21. Here, the breaking stress where the member breaks is set to be 100 [N/mm$^2$].

In Example 1-2, under the condition of Example 1-1, the revolution load is increased until the member breaks. As a result, the revolution load is 300 [N·cm]. Thus, Example 1-2 is a simulation under this condition.

In Example 1-1, parts having a high stress arose in the support part 24 or the transport part 26. However, even in the part on the base end side of the support part 24 where the highest stress is generated, the stress is in the order of 30 MPa to 40 MPa which is approximately half the breaking stress. Thus, no breakage has been concluded. Where the torque is 300 N·cm, breakage has been concluded in the base end part of the support part 24 where the highest stress is generated. Here, in general, the motor for driving the toner cartridges Ky to Kk of the image forming apparatus U has a rated torque of 2.0 N·m=200 N·cm or the like in many cases. Further, as a result of an experiment, even in a case that developing powder unit has been stored in a warehouse or the like for three years or the like so that the developing powder has been displaced toward the service opening side and pressed and aggregated owing to the self-weight, the torque at the time of drive start hardly exceeds 1.0 [N·m]. Further, when the term of storage is twice, the torque at the time of drive start reaches the order of 1.0 [N·m]. Thus, it has been concluded that the agitator 16 composed of resin is satisfactorily feasible in practical use.

Exemplary Embodiment 2

Next, Exemplary embodiment 2 of the present invention is described below. In the description of Exemplary embodiment 2, components corresponding to those in Exemplary embodiment 1 are designated by like numerals. Then, their detailed description is omitted.

Exemplary embodiment 2 is different from Exemplary embodiment 1 in the points described below. However, in the other points, Exemplary embodiment 2 is similar to Exemplary embodiment 1.

Figure 10:
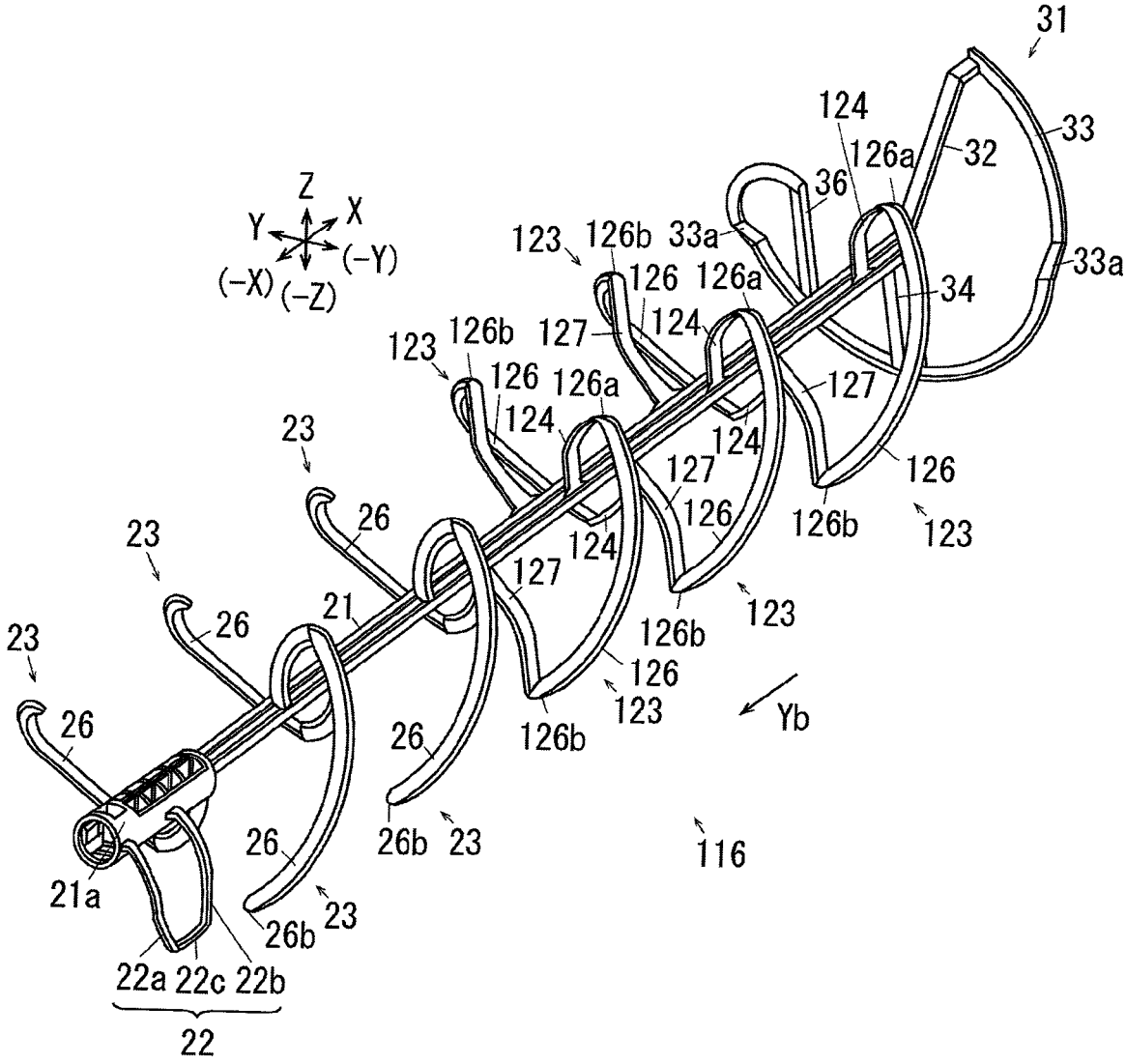
FIG. 10 is an explanation diagram showing a transport member according to Exemplary embodiment 2.

FIG. 10 is an explanation diagram showing the transport member according to Exemplary embodiment 2.

In FIG. 10, in the agitator 116 according to Exemplary embodiment 2, in five second helical members 123 arranged in the upstream of the developing powder transport direction Yb, by the one-end-side support part 127 links between the one end part 126*b* of the second transport part 126 and the shaft 21. That is, the second transport part 126 arranged in the upstream is supported in a double-end supported state. Thus, in the agitator 116 according to Exemplary embodiment 2, in five second transport parts 126 arranged in the upstream of the developing powder transport direction Yb, the other end part 126*a* and the one end part 126*b* are both not in a free end state. In contrast, in four first transport parts 26 arranged in the downstream, the one end part 26*b* is constructed as a free end.

Operation of Exemplary Embodiment 2

In the agitator 116 having the above-mentioned configuration according to Exemplary embodiment 2, in the downstream of the developing powder transport direction Yb where a relatively large amount of developing powder stays as a result of transport, the first transport part 26 in a cantilever state reduces a driving torque increase and breakage occurrence. Further, in the upstream of the developing powder transport direction Yb where a relatively small amount of developing powder stays and hence a relatively low load acts on the second transport part 126, the second transport parts 126 in a double-end supported state are arranged so that deformation and helix spreading in the second transport part 126 are suppressed. Thus, in the shaft 21 supported at the rear end in the axial direction in a revolvable manner in a cantilever state by the rear cover 13, the second transport part 126 tends to easily contact with the inner peripheral surface of the cartridge body 11 on the front side where a larger deflection is easily caused when the shaft 21 is deflected at the time of revolution, that is, on the upstream side of the transport direction. In contrast, in Exemplary embodiment 2, spreading in the helix of the second transport part 126 is suppressed, and hence a situation that the second transport part 126 contacts the inner peripheral surface of the cartridge body 11 is suppressed in comparison with Exemplary embodiment 1.

Exemplary Embodiment 3

Next, Exemplary embodiment 3 of the present invention is described below. In the description of Exemplary embodiment 3, components corresponding to those in Exemplary embodiment 1 are designated by like numerals. Then, their detailed description is omitted.

Exemplary embodiment 3 is different from Exemplary embodiment 1 in the points described below. However, in the other points, Exemplary embodiment 3 is similar to Exemplary embodiment 1.

Figures 11A, 11B, 11C:
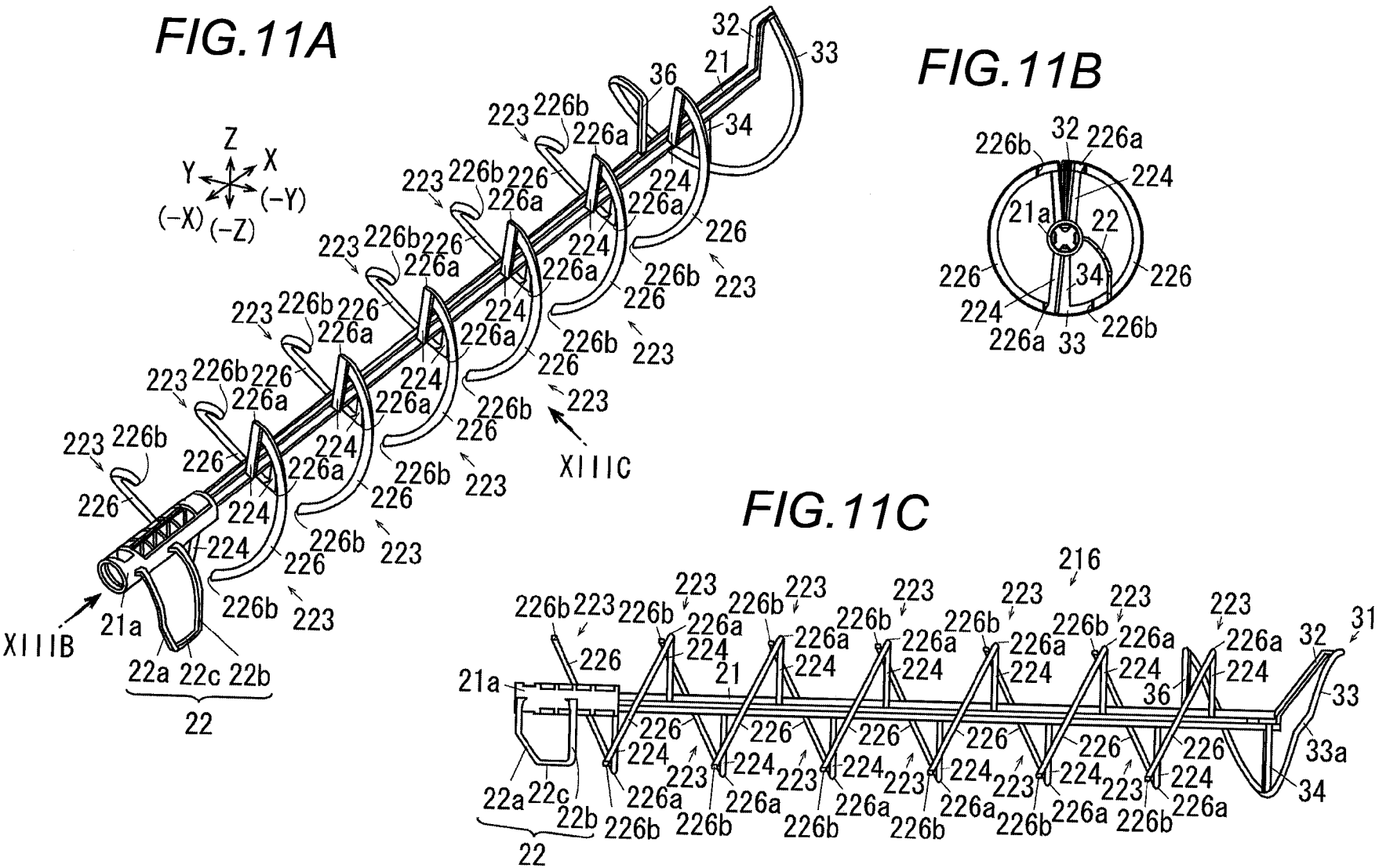
FIG. 11A is a perspective view of an explanation diagram showing an agitator according to Exemplary embodiment 3.
FIG. 11B shows a view from an arrow XIIIB direction in FIG. 11A.
FIG. 11C shows a view from an arrow XIIIC direction in FIG. 11A.

FIG. 11A is a perspective view of an explanation diagram showing the agitator according to Exemplary embodiment 3. FIG. 11B shows a view from an arrow XIIIB direction in FIG. 11A. FIG. 11C shows a view from a narrow XIIIC direction in FIG. 11A.

In FIG. 11A, in the helical member 223 of the agitator 216 according to Exemplary embodiment 3, in contrast to the support part 24 according to Exemplary embodiment 1, the support part 224 according to Exemplary embodiment 3 extends straight along the radial direction. Further, in correspondence to this, the transport part 226 has a wider central angle than that in Exemplary embodiment 1.

Operation of Exemplary Embodiment 3

In the agitator 216 having the above-mentioned configuration according to Exemplary embodiment 3, similarly to Exemplary embodiment 1, even when the agitator 216 is fabricated from a resin material having a lower strength than metals, an agitator 16 is realized and obtained that does not cause an excessive transport resistance and an excessive driving torque and that has damage resistance, a reduced raw material cost, and a reduced production cost in mass production.

Exemplary Embodiment 4

Next, Exemplary embodiment 4 of the present invention is described below. In the description of Exemplary embodiment 4, components corresponding to those in Exemplary embodiment 1 are designated by like numerals. Then, their detailed description is omitted.

Exemplary embodiment 4 is different from Exemplary embodiment 1 in the points described below. However, in the other points, Exemplary embodiment 4 is similar to Exemplary embodiment 1.

Figure 12:
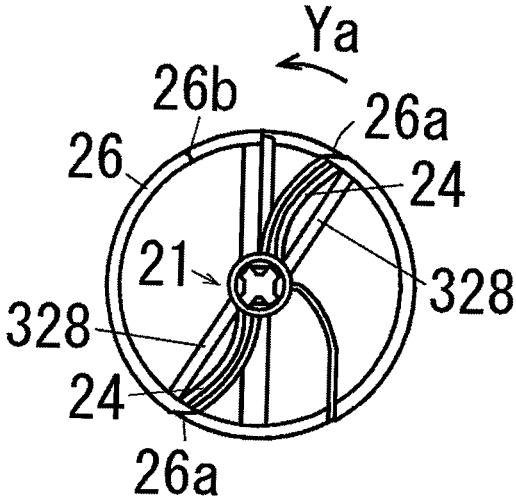
FIG. 12 is an explanation diagram showing an agitator according to Exemplary embodiment 4, and corresponds to FIG. 7C of Exemplary embodiment 1.

FIG. 12 is an explanation diagram showing an agitator according to Exemplary embodiment 4, and corresponds to FIG. 7C of Exemplary embodiment 1.

In FIG. 12, in the agitator 316 according to Exemplary embodiment 4, a reinforcement part 328 that extends in the radial direction and connects the shaft 21 and the transport part 26 and that serves as an example of a second support part is formed near the support part 24 in a manner of being adjacent to the support part 24. Here, in Exemplary embodiment 4, the reinforcement part 328 is arranged at a position in the upstream of the revolution direction Ya by 5 degrees or the like in terms of central angle relative to the support part 24. Here, the angle may be a value smaller than or equal to 90 degrees relative to the support part 24.

Operation of Exemplary Embodiment 4

In the agitator 316 having the above-mentioned configuration according to Exemplary embodiment 4, the transport part 26 is supported by the reinforcement part 328 and the support part 24. Thus, when a load acts on the transport part 26, the load acting on the other end part 26*a* on the base end side is received by both of the support part 24 and the reinforcement part 328. Accordingly, the entirety strength is increased in comparison with Exemplary embodiment 1. Further, similarly to Exemplary embodiment 1, even when the agitator 16 is fabricated from a resin material having a lower strength than metals, an agitator 16 is realized and obtained that does not cause an excessive transport resistance and an excessive driving torque and that has damage resistance, a reduced raw material cost, and a reduced production cost in mass production.

Figure 13A:
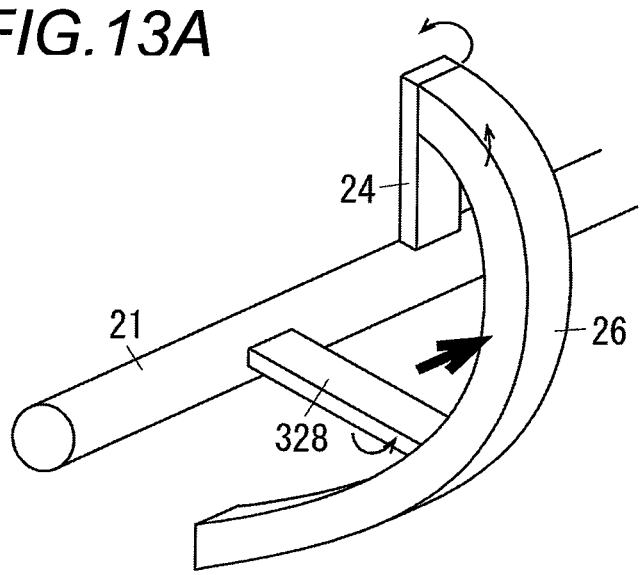
FIG. 13A is an explanation diagram showing a state that a reinforcement part is arranged at a position of 90 degrees relative to a support part for Exemplary embodiment 4 and FIG. 13B is an explanation diagram showing a state that a reinforcement part is arranged at a position of 180 degrees relative to a support part for Exemplary embodiment 4.
Figure 13B:
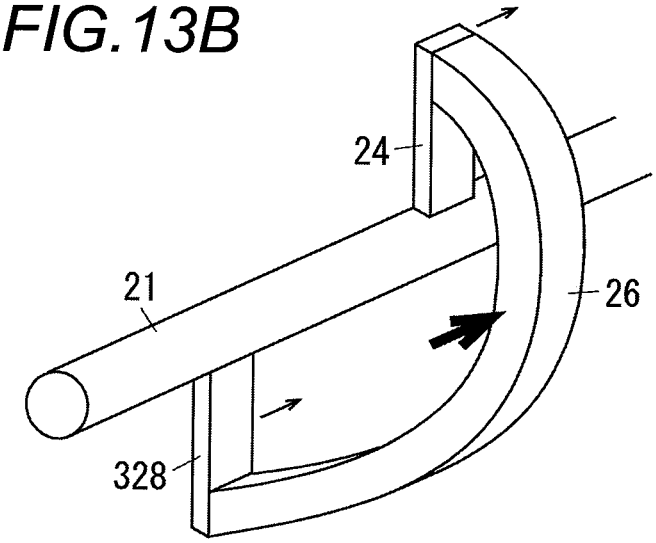

FIG. 13A is an operation explanation diagram showing a state that a reinforcement part is arranged at a position of 90 degrees relative to the support part for Exemplary embodiment 4. FIG. 13B is an operation explanation diagram showing a state that a reinforcement part is arranged at a position of 180 degrees relative to the support part.

Here, in FIGS. 15A and 15B, members necessary in description are solely illustrated. Further, illustration of these members is simplified.

In FIGS. 14 and 15A, in Exemplary embodiment 4, the reinforcement part 328 is arranged at a position of 90 degrees or smaller relative to the support part 24. Since the reinforcement part 328 is arranged at a position of 90 degrees or smaller as shown in FIG. 13A, when the transport part 26 receives a reactive force from the developing powder, that is, a force along the axial direction of the shaft 21, in accordance with the deformation of the transport part 26 inclined in the axial direction, the support part 24 and the reinforcement part 328 receive a force for twisting them in the similar direction. This increases the resistance against deformation, and hence reduces the deformation. If the reinforcement part is formed at a position of 180 degrees as shown in FIG. 13B, when the transport part 26 receives a force for causing deformation along the axial direction of the shaft 21, the support part 24 and the reinforcement part 328 receive a force in the axial direction instead of that in the twisting direction, and hence easily deformed in the axial direction. Thus, in the state shown in FIG. 13B, even after the force received from the developing powder is released, restoration from the deformed state is often unsatisfactory.

Modifications

Exemplary embodiments of the present invention have been described above in detail. However, the present invention is not limited to these exemplary embodiments. That is, various kinds of modifications can be performed within the scope of the present invention. Examples of modifications (H01) to (H07) to the present invention are described below.

(H01) In the exemplary embodiments given above, a copying machine has been employed as an image forming apparatus. However, the present invention is not limited to this. That is, a FAX machine, a printer, or alternatively a combined machine having all or plural of these functions may be employed. Further, the description has been given for the case of an image forming apparatus having image carriers PRy to PRk, developing apparatuses Gy to Gk, and latent image forming apparatuses LHy to LHk for four colors. However, the present invention is not limited to this configuration. That is, the present invention is applicable also to a monochrome image forming apparatus or alternatively a rotary-type image forming apparatus in which a single image carrier and a single latent image forming apparatus are provided and in which four developing apparatuses revolve so as to sequentially oppose the image carrier.

(H02) In the exemplary embodiments given above, the moderate inclination parts 33*a* have been provided only in the front-side helical member 31. However, the present invention is not limited to this configuration. That is, moderate inclination parts 33*a* may be provided also in the transport parts 26, 126, and 226.

(H03) In the exemplary embodiments given above, the flow-out opening agitating member 22 and the front-side helical member 31 may be omitted, or alternatively may be replaced by helical members 23, 123, and 223.

(H04) In the exemplary embodiments given above, the agitator 16 has been provided with a common structure for each of the toner cartridges Ky, Km, Kc, and Kk for four colors. However, the present invention is not limited to this configuration. That is, the configuration of the agitator may be different between the toner cartridges. For example, the capacity of the black toner cartridge Kk having the highest frequency of usage may be enhanced. Then, the diameter and the shape of the agitator 16 may be changed in correspondence to the capacity enhancement.

(H05) The number of helical members 23, 123, or 223, the arrangement space, the phase shift, the central angle of the transport part, and the like are not limited to the particular values given in the exemplary embodiments, and hence may be arbitrary values. For example, arrangement has been performed with intervals of a phase 180 degrees in terms of the central angle. However, the present invention is not limited to this setting. For example, 270 degrees intervals, 120 degrees intervals, or the like may be employed. Then, in correspondence to this, the central angle of the helix transport part 26, 126, or 226 may also be changed. Further, for example, when contact of the transport part 26, 126, or 226 with the inner wall surface of the cartridge body 11 at the time of deformation is to be avoided, the length measured from the other end part 26*a* of the transport part 26 to the one end part 26*b* of the transport part 26 along the revolution direction Ya of the revolving shaft 21 may be set smaller or equal to the length of the diameter around the revolving shaft 21 serving as a center to an outer edge in the radial direction of the transport part 26.

(H06) In the exemplary embodiments given above, the agitator 16 used in each of the toner cartridges Ky to Kk has been described. However, the present invention is not limited to the agitator for the toner cartridges Ky to Kk, and is applicable to a transport member for transporting developing powder in an image forming apparatus. For example, the present invention may be applied to: a transport member arranged in a supply path for transporting to the developing apparatus the developing powder supplied through a service opening of the toner cartridges Ky to Kk; and a transport member arranged in a discarding path for transporting the developing powder collected by the cleaners CLy to CLk and CLb to a discarded developing powder container.

(H07) In the exemplary embodiments given above, the transport members 16, 116, 216, and 316 have been described that transport developing powder serving as an example of powder. However, the present invention is not limited to this configuration. That is, the present invention may be applied in transport of powder other than developing powder, like flour, resin powder, and chemicals.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A transport member for a powder transport comprising:

a revolving shaft;

plural transport parts including at least one transport part that extends in a helical shape relative to an axial direction of the revolving shaft in a nonoperating status, the at least one transport part including one end part with a free end and an other end part at an opposite side of the one end part, and transporting a powder at the time of revolution of the revolving shaft;

a support part that supports the other end part of the at least one transport part by being arranged with the revolving shaft; and a reinforcement part that is arranged adjacent to the support and connects between an adjacent portion of the other end part of the at least one transport part and the revolving shaft, wherein the at least on transport part is not supported by a second support part, or the at least one transport part is supported by the second support part that is arranged at a phase angle between the support part and the second support part of more than 0 degrees and less than 90 degrees, with respect to a perpendicular cross-section of an axial direction of the revolving shaft, wherein a central angle of a helix arc, which is between the free end and the other end part of the at least one transport part, is more than 90 degrees with respect to a perpendicular cross-section of an axial direction of the revolving shaft.

2. The transport member for the powder transport according to claim 1, wherein a central angle of a helix arc relative to the revolving shaft is less than 360 degrees.

3. A developing powder accommodation container comprising:

a developing powder accommodation part that accommodates developing powder; and a transport member including:

a revolving shaft;

plural transport parts including at least one transport part that extends in a helical shape relative to an axial direction of the revolving shaft in a nonoperating status, the at least one transport part including one end part with a free end and an other end part at an opposite side of the one end part, and transporting a powder at the time of revolution of the revolving shaft; and a support part that supports the other end part of the at least one transport part by being arranged with the revolving shaft, wherein the at least on transport part is not supported by a second support part, or the at least one transport part is supported by the second support part that is arranged at a phase angle between the support part and the second support part of more than 0 degrees and less than 90 degrees, with respect to a perpendicular cross-section of an axial direction of the revolving shaft, and the transport member transports a developing powder from the other end part toward the free end part, wherein a central angle of a helix arc, which is between the free end and the other end part of the at least one transport part, is more than 90 degrees with respect to a perpendicular cross-section of an axial direction of the revolving shaft, wherein a length from the one end part of the at least one transport part to the other part of the at least one transport part along a revolution direction of the revolving shaft is smaller or equal to a length of a diameter around the revolving shaft serving as a center to an outer edge in a radial direction of the at least one transport part.

4. A developing powder accommodation container comprising:

a developing powder accommodation part that accommodates developing powder; and a transport member including:

a revolving shaft;

plural transport parts in which at least one transport part that extends in a helical shape relative to an axial direction of the revolving shaft in a nonoperating status, the at least one transport part including one end part with a free end and an other end part at an opposite side of the one end part, and transporting a powder at the time of revolution of the revolving shaft; and a support part that supports the other end part of the at least one transport part by being arranged with the revolving shaft, wherein the at least one transport part is not supported by a second support part, or the at least one transport part is supported by the second support part that is arranged at a phase angle between the support part and the second support part of more than 0 degrees and less than 90 degrees, with respect to a perpendicular cross-section of an axial direction of the revolving shaft, and the transport member transports a developing powder from the other end part toward the free end part, wherein a central angle of a helix arc, which is between the free end and the other end part of the at least one transport part, is more than 90 degrees with respect to a perpendicular cross-section of an axial direction of the revolving shaft, wherein the at least one transport part includes a first transport portion and a second transport portion, the first transport portion is arranged in a downstream of the developing powder transport direction relative to an axial direction of the revolving shaft, and the second transport portion is arranged in an upstream of the developing powder transport direction relative to the axial direction of the revolving shaft, extends in a helical shape relative to the axial direction of the revolving shaft, and transports a powder at the time of revolution of the revolving shaft, wherein the one end part of the second transport portion is supported by a first support part arranged with the revolving shaft, and the other end part of the second transport portion is supported by a second support part arranged with the revolving shaft.

5. An image forming apparatus comprising:

an image carrier;

a latent image forming apparatus that forms a latent image onto a surface of the image carrier;

a developing apparatus that develops the latent image on the surface of the image carrier into a visible image;

a transfer apparatus that transfers the visible image on the surface of the image carrier onto a medium;

a fixing apparatus that fixes the visible image on a surface of the medium;

a developing powder accommodation part that accommodates a developing powder to be supplied to the developing apparatus; and a transport member that is revolvably supported in an inside of the developing powder accommodation part, including:

a revolving shaft;

plural transport parts including at least one transport part that extends in a helical shape relative to an axial direction of the revolving shaft in a nonoperating status, the at least one transport part including one end part with a free end and an other end part at an opposite side of the one end part, and transporting a powder at the time of revolution of the revolving shaft; and a support part that supports the other end part of the at least one transport part by being arranged with the revolving shaft; and a reinforcement part that is arranged adjacent to the support part and connects between an adjacent portion of the other end part of the at least one transport part and the revolving shaft, wherein the at least one transport part is not supported by a second support part, or the at least one transport part is supported by the second support part that is arranged at a phase angle between the support part and the second support part of more than 0 degrees and less than 90 degrees, with respect to a perpendicular cross-section of an axial direction of the revolving shaft, wherein a central angle of a helix arc, which is between the free end and the other end part of the at least one transport part, is more than 90 degrees with respect to a perpendicular cross-section of an axial direction of the revolving shaft.

6. An image forming apparatus comprising:

an image carrier;

a latent image forming apparatus that forms a latent image onto a surface of the image carrier;

a developing apparatus that develops the latent image on the surface of the image carrier into a visible image;

a transfer apparatus that transfers the visible image on the surface of the image carrier onto a medium;

a fixing apparatus that fixes the visible image on a surface of the medium;

a cleaning device that cleans a residue on the surface of the image carrier after a transfer;

a developing powder accommodation part that accommodates a developing powder collected by the cleaning device; and a transport member that is revolvably supported in an inside of the developing powder accommodation part, including:

a revolving shaft;

plural transport parts including at least one transport part that extends in a helical shape relative to an axial direction of the revolving shaft in a nonoperating status, the at least one transport part including one end part with a free end and an other end part at an opposite side of the one end part, and transporting a powder at the time of revolution of the revolving shaft; and a support part that supports the other end part of the at least one transport part by being arranged with the revolving shaft; and a reinforcement part that is arranged adjacent to the support part and connects between an adjacent portion of the other end part of the at least one transport part and the revolving shaft, wherein the at least one transport part is not supported by a second support part, or the at least one transport part is supported by the second support part that is arranged at a phase angle between the support part and the second support part of more than 0 degrees and less than 90 degrees, with respect to a perpendicular cross-section of an axial direction of the revolving shaft, wherein a central angle of a helix arc, which is between the free end and the other end part of the at least one transport part, is more than 90 degrees with respect to a perpendicular cross-section of an axial direction of the revolving shaft.

7. A transport member for a powder transport comprising:

a revolving shaft;

plural transport parts including at least one transport part that extends in a helical shape relative to an axial direction of the revolving shaft in a nonoperating status, the at least one transport part including one end part with a free end and an other end part at an opposite side of the one end part, and transporting a powder at the time of revolution of the revolving shaft; and a support part that supports the other end part of the at least one transport part by being arranged with the revolving shaft, wherein the at least one transport part is not supported by another support part that is arranged at a phase angle, which is an angle in a revolution direction of the revolving shaft, between the support part and the another support part of 90 degrees or more, in a direction of the revolving shaft, and the transport member further comprises a reinforcement part that is arranged with an interval of an angle in a revolution direction of the revolving shaft of more than 0 degrees and no more than 90 degrees from the support part and that connects between the at least one transport part and the revolving shaft, wherein a central angle of a helix arc, which is between the free end and the other end part of the at least one transport part, is more than 90 degrees with respect to a perpendicular cross-section of an axial direction of the revolving shaft.

* * * * *